US005983692A

United States Patent [19]

Brück

[11] Patent Number: 5,983,692

[45] Date of Patent: Nov. 16, 1999

[54] PROCESS AND APPARATUSES FOR PRODUCING A METAL SHEET WITH A CORRUGATION CONFIGURATION AND A MICROSTRUCTURE DISPOSED TRANSVERSELY WITH RESPECT THERETO

[75] Inventor: Rolf Brück, Bergisch Gladbach, Germany

[73] Assignee: EMITEC Gesellschaft fuer Emissionstechnologie mbH, Lohmar, Germany

[21] Appl. No.: 09/264,275

[22] Filed: Mar. 8, 1999

Related U.S. Application Data

[63] Continuation of application No. PCT/EP97/04469, Aug. 14, 1997.

[30] Foreign Application Priority Data

Sep. 6, 1996 [DE] Germany ..... 196 36 367

[51] Int. Cl.[6] ..... B21D 13/10

[52] U.S. Cl. ..... 72/187; 72/196

[58] Field of Search ..... 72/187, 196

[56] References Cited

U.S. PATENT DOCUMENTS 1,449,596 3/1923 Fraidus ..... 72/196
2,241,146 5/1941 Little ..... 72/196
3,998,600 12/1976 Wallis ..... 72/187
4,888,972 12/1989 Rouse .

FOREIGN PATENT DOCUMENTS 30 49 459 A1 2/1982 Germany .
41 37 329 A1 5/1993 Germany .

OTHER PUBLICATIONS

International Publication No. WO 90/08249 (Maus et al.), dated Jul. 26, 1990.
International Publication No. WO 96/09892 (Bode et al.), dated Apr. 4, 1996.

*Primary Examiner*—Lowell A. Larson
*Attorney, Agent, or Firm*—Herbert L. Lerner; Laurence A. Greenberg

[57] ABSTRACT

An apparatus for producing a metal sheet with a corrugation configuration that is of a first corrugation height, wherein the sheet has transversely or at an angle relative to the corrugation configuration a microstructure having a second, substantially smaller corrugation height. The apparatus includes a device for producing the microstructure, and a pair of mutually meshing corrugation rollers that are disposed downstream of the device for producing the microstructure. Wherein the corrugation rollers have at their outer surfaces recesses which are suitably disposed and sufficiently large to receive the microstructures, so that the microstructures are not deformed by the corrugation rollers in the operation of corrugating the metal sheet.

11 Claims, 1 Drawing Sheet

PROCESS AND APPARATUSES FOR PRODUCING A METAL SHEET WITH A CORRUGATION CONFIGURATION AND A MICROSTRUCTURE DISPOSED TRANSVERSELY WITH RESPECT THERETO

CROSS-REFERENCE TO RELATED APPLICATION

This is a continuation of copending International Application PCT/EP97/04469, filed Aug. 14, 1997, which designated the United States.

BACKGROUND OF THE INVENTION

FIELD OF THE INVENTION

The present invention concerns a process and apparatuses for producing a metal sheet with a corrugation configuration that is of a first predetermined corrugation height, wherein the sheet, transversely or at an angle to the corrugation, has a microstructure with a second, substantially smaller corrugation height. Metal sheets of this kind are processed in particular to form honeycomb bodies for catalytic converters as are used in particular in exhaust gas systems of motor vehicles. The invention however is not limited to that use as for example uses in heat exchangers are also possible.

Details in regard to the form and the advantages of such microstructures are described for example in International Patent Applications WO 90/08249, corresponding to U.S. Pat. No. 5,157,010, or WO 96/09892. As is already the case in the state of the art, a microstructure in a corrugated sheet denotes a structure which is of substantially smaller height than the corrugation configuration of the sheet. In particular a microstructure can project from a sheet at one or both sides, more specifically for example by at least 15 $\mu$ or 0.01 to about 0.3 times the corrugation height of the metal sheet.

Corrugated metal sheets are generally produced in the state of the art by corrugation rollers which mesh with each other and which preferably have an involute tooth configuration or a tooth configuration of a similar configuration. Other corrugation shapes, for example a trapezium shape, a zig-zag shape etc. are also known. In a honeycomb body through which exhaust gas flows, in particular in a catalytic converter, microstructures which extend transversely or angled relative to the flow direction, so-called transverse structures (referred to as the TS-configuration), provide for a better transfer of heat between the exhaust gas and the honeycomb body and an improvement in the diffusion procedures which are important in regard to the catalytic effectiveness of the honeycomb body.

The state of the art therefore provides for disposing microstructures at given spacings in succession in the flow direction, in particular at spacings of less than 20 mm and in particular less than 10 mm.

As the microstructures are relatively small in comparison with the typical thickness of the sheets for the honeycomb bodies, it was hitherto assumed that they do not cause problems to a substantial degree in the further manufacturing procedure so that processing was effected using the usual corrugation rollers and moreover with known production steps for forming the honeycomb body.

It has been found however that, when corrugating a sheet that already has microstructures, those microstructures are in part pressed flat again, while in addition that also occurs irregularly, depending on the clearance of the corrugation rollers relative to each other. In that kind of production procedure the microstructures firstly had to be produced with a larger corrugation height than was wanted in the final result, in order to compensate for that effect. When dealing with quite a number of starting materials the cold shaping effects that occur in that situation could only be achieved with difficulty, without causing damage. That problem becomes more acute when dealing with ever thinner sheets and ever smaller corrugation heights. Honeycomb bodies with for example 500 cells per square inch (cpsi) and more are in demand, in which case sheets having a thickness of below 30 $\mu$m are used resulting in more serious difficulties in terms of manufacturing procedures.

SUMMARY OF THE INVENTION

It is accordingly an object of the invention to provide a process and apparatuses for producing a metal sheet with a corrugation configuration and a microstructure disposed transversely with respect thereto that overcome the above-mentioned disadvantages of the prior art devices and methods of this general type, in which corrugated metal sheets with microstructures extending transversely or angled relative to the corrugation can be produced economically and without unacceptable cold deformation.

With the foregoing and other objects in view there is provided, in accordance with the invention, an apparatus for producing a metal sheet having a corrugation structure with a first corrugation height, the sheet having at an angle relative to the corrugation structure a microstructure having a second corrugation height substantially smaller than the first corrugation height, including: a device for producing microstructures on a metallic sheet; and a pair of mutually meshing corrugation rollers disposed downstream of the device for producing the microstructures, the mutually meshing corrugation rollers having outer surfaces with recesses formed therein dimensioned and disposed for receiving the microstructures so that the microstructures are not deformed by the mutually meshing corrugation rollers in an operation of corrugating the metallic sheet for forming a corrugation structure having corrugation crests in the metallic sheet.

The apparatus according to the invention for producing the metal sheet with the corrugation configuration has the first corrugation height, wherein the sheet has transversely or at an angle relative to the corrugation configuration a microstructure of a second, substantially smaller corrugation height, includes a device for producing the microstructure. A pair of mutually meshing corrugation rollers which are disposed downstream of the device for producing the microstructure, wherein the corrugation rollers have at their outer surfaces recesses which are suitably disposed and/or sufficiently large to receive the microstructures so that the microstructures are not deformed by the corrugation rollers when corrugating the metal sheet. Although the production of such a pair of corrugation rollers is relatively expensive, in particular for angled extending microstructures, there is nonetheless the crucial advantage that microstructures can be produced with an exactly defined height which remains the same throughout, without very substantial cold shaping firstly having to be effected, which shaping later is partially pressed flat again by the corrugating procedure. Such an apparatus can therefore be used without difficulty in particular also for the production of microstructures in corrugated sheet metal layers of a thickness of for example 25 to 50 $\mu$m.

Typically corrugation rollers with a kind of involute tooth configuration are used, although the invention is not limited to that kind of rollers. In general all kinds of corrugation rollers have a certain degree of clearance relative to each other, whereby spacings which can only be reproduced with difficulty can occur at the flanks and/or on the peaks of the teeth or in the intermediate spaces between the teeth, during the production procedure. In the case of the corrugation rollers which are provided in accordance with the invention with recesses, the clearance between the rollers has no influence on the final height of the microstructures.

It is a particularly simple manner for the recesses to be in the form of grooves that should correspond in terms of their width and depth at least to the width and height respectively of the microstructures. It is however also possible for the microstructures to be possibly subsequently shaped again by suitably shaped grooves.

It is also important in connection with the apparatus according to the invention that the device for producing the microstructure and the corrugation rollers are adjustable relative to each other in such a way that the microstructures produced always pass into recesses in the corrugation rollers. The easiest way of achieving that is to adopt a very close spatial arrangement, but that can also be achieved by suitable adjustment devices, if larger spacings are involved.

Typically honeycomb bodies are formed from alternate layers of smooth and corrugated sheets or alternate layers of sheets corrugated in different ways, in which respect different construction configurations are known, for example sheet layers which are wound in a spiral shape, twisted in an s-shape or twisted in the manner of an involute.

If sheet metal layers of that kind which are disposed in mutually superposed relationship are to be welded or brazed together, the microstructures, depending on their respective height, can under some circumstances result in troublesome spacings between the sheet layers. The gaps between adjacent sheet layers, which are caused by the microstructures, can only be bridged over with difficulty by solder or brazing material, as from a given size of gap, and for that reason microstructures on the corrugation crests on both sides of the corrugated sheet layers may sometimes be undesirable. To deal with that situation, a particular embodiment of the apparatus according to the invention provides that disposed downstream of the corrugation rollers is at least one smoothing device which can press flat again the microstructures on the corrugation crests of the corrugated sheet, at one or both sides thereof. Such a device may be for example a corrugation roller with recesses, which runs against a flat roller. That procedure provides for pressing flat only microstructures on the corrugation crests, where they do not in any case have influence on the flow which later flows in the honeycomb body, whereby bonding by solder or brazing material is substantially simplified. The other microstructures remain unchanged and can perform their intended function without further giving rise to problems in the production procedure.

Alternatively it is also possible, instead of corrugation rollers and a smoothing device disposed downstream thereof, to use special corrugation rollers which do not have any recesses in their corrugation troughs, so that the microstructures can be pressed flat there. That can be particularly satisfactorily achieved if the corrugation rollers involve only a slight clearance between mutually oppositely disposed corrugation troughs and corrugation crests.

The process according to the invention for producing a metal sheet with a corrugation configuration and a microstructure includes the following steps:

a) producing the microstructure in an initially uncorrugated metal sheet;

b) feeding the metal sheet to a pair of mutually meshing corrugation rollers which have recesses disposed in the correct position in relation to the microstructures, for receiving the microstructures; and c) corrugating the sheet strip without pressing the microstructures flat.

As already explained above, the procedure gives rise to defined microstructures which are no longer deformed after they have been produced and which can therefore be formed in a very well-defined and reproducible manner. To avoid gaps between sheet metal layers which bear against each other and which are to be soldered or welded to each other, the microstructures on the corrugation crests on at least one of the two sides can be pressed flat in the corrugation rollers or in a subsequent smoothing device.

Other features which are considered as characteristic for the invention are set forth in the appended claims.

Although the invention is illustrated and described herein as embodied in a process and apparatuses for producing a metal sheet with a corrugation configuration and a microstructure disposed transversely with respect thereto, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
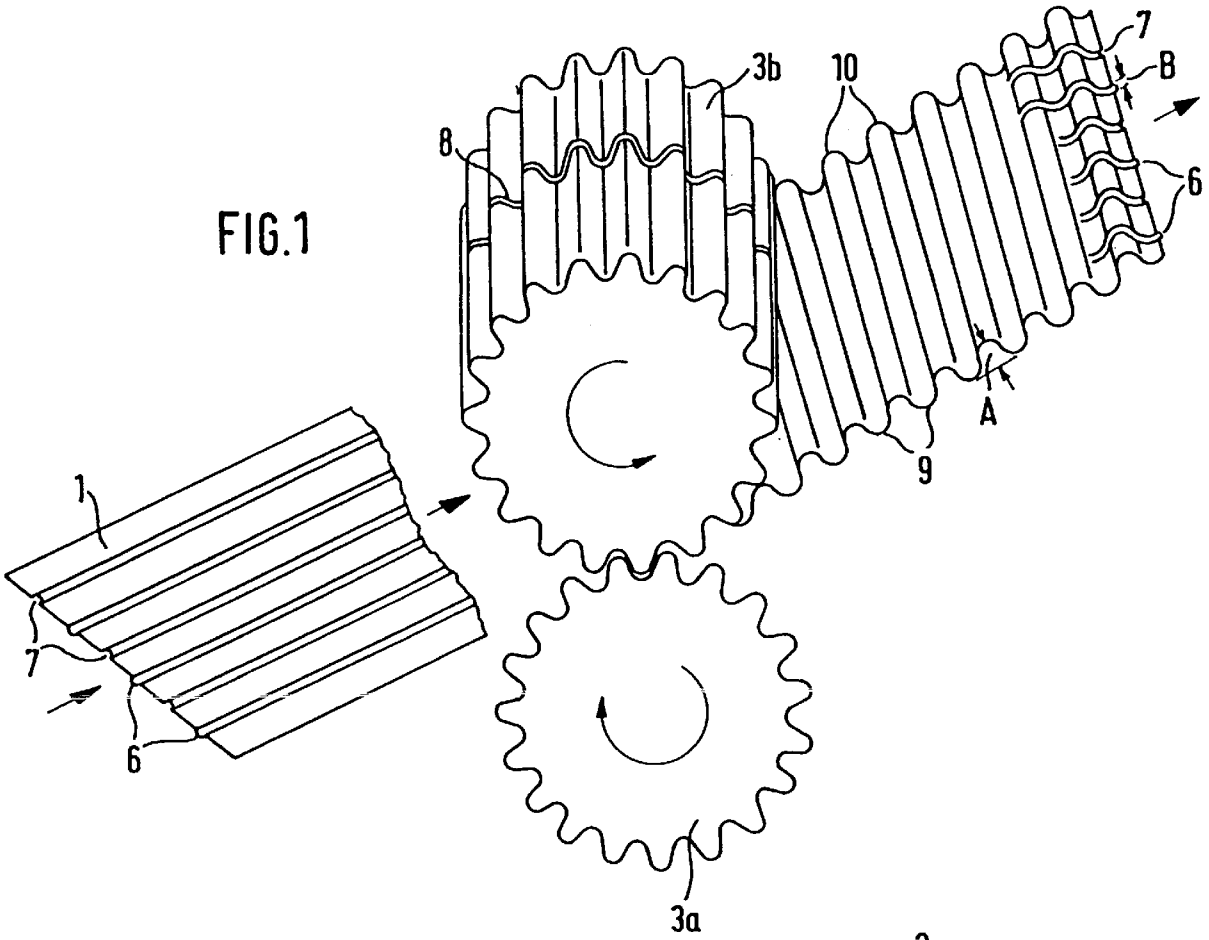
FIG. 1 is a diagrammatic, perspective view of a corrugation apparatus according to the invention.

In all the figures of the drawing, sub-features and integral parts that correspond to one another bear the same reference symbol in each case. Referring now to the figures of the drawing in detail and first, particularly, to FIG. 1 thereof, there is shown the heart of the present invention, namely a corrugation device for metal sheets. A metal sheet 1 which has already been provided in a device for producing microstructures with downwardly facing microstructures 6 and upwardly facing microstructures 7 is fed to a pair of corrugation rollers 3*a*, 3*b*. At a surface the corrugation rollers 3*a*, 3*b* have recesses 8 that are in particular in the form of grooves 8. The recesses 8 of which only one is shown in the drawing receive the previously produced microstructures 6, 7 so that they are not affected by the corrugation process when corrugating the sheet. That results in a sheet which is corrugated with a first corrugation height A and has corrugation crests 9, 10 at its top and bottom sides. The microstructures 6, 7 are substantially smaller in their height B than the first corrugation height A of the corrugated metal sheet 1.

Figure 2:
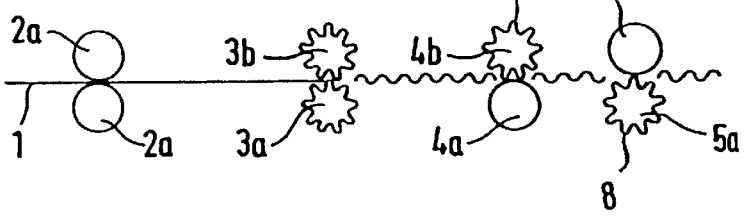
FIG. 2 is a diagrammatic view of a production procedure.

FIG. 2 diagrammatically shows the production procedure for producing a corrugated sheet 1 with microstructures 6,7. The metal sheet 1 first passes through a device 2*a*, 2*b* for producing the microstructures 6,7, as is known from the state of the art. In particular this may involve cylindrical rollers with corresponding surface structures or individual narrow disks which are disposed in a row with each other and which apply the microstructure 6,7 to the metal sheet 1 by a cold shaping effect. The metal sheet 1 is then fed to a pair of the corrugation rollers 3*a*, 3*b*, as are shown in greater detail in FIG. 1. In the situation where the microstructures 6, 7 are not wanted on the corrugation crests 9, 10 of the corrugated metal sheet 1, they can be smoothed by smoothing devices 4*a*, 4*b* and 5*a*, 5*b* respectively. Such smoothing devices include for example a cylindrical roller 4*a* and 5*b* respectively with a smooth surface, which runs against the corrugation rollers 4*b* and 5*a*, respectively, the corrugation rollers 4*b*, 5*a* preferably having the same recesses 8 as those that are used to produce the corrugation.

Corrugated metal sheets produced in that way and provided with microstructures 6, 7 can be used in particular for honeycomb bodies in exhaust gas systems. They increase the transfer of heat between the honeycomb body and a fluid flowing therethrough and they accelerate diffusion phenomena, which is advantageous in particular in terms of the effectiveness of a catalytic converter.

I claim:

1. An apparatus for producing a metal sheet having a corrugation structure with a first corrugation height, the metal sheet having at an angle relative to the corrugation structure a microstructure having a second corrugation height substantially smaller than the first corrugation height, comprising:

a device for producing microstructures on a metallic sheet; and a pair of mutually meshing corrugation rollers disposed downstream of the device for producing the microstructures, said mutually meshing corrugation rollers having outer surfaces with recesses formed therein dimensioned and disposed for receiving the microstructures so that the microstructures are not deformed by said mutually meshing corrugation rollers in an operation of corrugating the metallic sheet for forming a corrugated structure having corrugation crests in the metallic sheet.

2. The apparatus according to claim 1, wherein said mutually meshing corrugation rollers have a tooth configuration.

3. The apparatus according to claim 2, wherein said tooth configuration is an involute tooth configuration.

4. The apparatus according to claim 1, wherein said recesses formed in said mutually meshing corrugation rollers are grooves extending in one of a peripheral direction and angled relative to the peripheral direction, the microstructures have a width and a height, and said grooves have a width and a depth corresponding at least to the width and the height of the microstructures.

5. The apparatus according to claim 1, wherein said device for producing the microstructures and said mutually meshing corrugation rollers are adjustable relative to each other such that the microstructures always pass into said recesses formed in said mutually meshing corrugation rollers.

6. The apparatus according to claim 1, including at least one smoothing device disposed downstream of said mutually meshed corrugation rollers for press flattening the microstructures disposed on the corrugation crests of at least one side of the corrugated structure of the metallic sheet.

7. The apparatus according to claim 6, wherein said at least one smoothing device has a corrugation roller with recesses formed therein and a flat roller running against said corrugation roller.

8. The apparatus according to claim 1, wherein said mutually meshing corrugation rollers have corrugation crests and corrugation troughs, said recesses formed in said mutually meshing corrugation rollers do not extend into said corrugation troughs for press flattening the microstructures in said corrugation troughs.

9. The apparatus according to claim 8, wherein said mutually meshing corrugation rollers have a slight distance between mutually oppositely disposed corrugation troughs and corrugation crests.

10. A process for producing a metal sheet with a corrugation configuration having a first corrugation height, the metal sheet has at an angle relative to the corrugation configuration a microstructure having a second corrugation height substantially smaller than the first corrugation height, which comprises:

producing microstructures in an initially uncorrugated metal sheet;

feeding the metal sheet to a pair of mutually meshing corrugation rollers having recesses formed therein and disposed and dimensioned in relation to the microstructures for receiving the microstructures; and corrugating the metal sheet without pressing the microstructures flat.

11. The process according to claim 10, which comprises pressing flat the microstructures on corrugation crests on at least one of the two sides of the metal sheet.

* * * * *